US011211740B2

(12) United States Patent
Arnoldi et al.

(10) Patent No.: US 11,211,740 B2
(45) Date of Patent: Dec. 28, 2021

(54) ELECTRIC UNIT FOR A MOTOR VEHICLE WITH A PLUG-IN CONNECTION, PLUG FOR A PLUG-IN CONNECTION ON AN ELECTRIC UNIT, AND METHOD FOR PRODUCING A PLUG FOR A PLUG-IN CONNECTION ON AN ELECTRIC UNIT

(71) Applicant: Hanon Systems Bad Homburg GmbH, Bad Homburg V. D. Höhe (DE)

(72) Inventors: Ernesto Giovanni Arnoldi, Luserna S. (IT); Paolo Lincoln Maurino, Bagnolo Piemonte (IT)

(73) Assignee: Hanon Systems Bad Homburg GmbH

( * ) Notice: Subject to any disclaimer, the term of this patent is extended or adjusted under 35 U.S.C. 154(b) by 0 days.

(21) Appl. No.: 16/826,829

(22) Filed: Mar. 23, 2020

(65) Prior Publication Data

US 2020/0313343 A1 Oct. 1, 2020

(30) Foreign Application Priority Data

Mar. 27, 2019 (DE) ..... 10 2019 204 226.0

(51) Int. Cl.
*H01R 13/52* (2006.01)
*H01R 13/533* (2006.01)
(Continued)

(52) U.S. Cl.
CPC ..... *H01R 13/5202* (2013.01); *F04D 29/08* (2013.01); *F04D 29/40* (2013.01);
(Continued)

(58) Field of Classification Search
CPC ..... H01R 13/5202; H01R 13/405; H01R 13/5216; H01R 13/533; H01R 13/5845; H01R 43/24; F04D 29/08; F04D 29/40
See application file for complete search history.

(56) References Cited

U.S. PATENT DOCUMENTS 7,621,752 B2 * 11/2009 Lin ..... F21S 41/153 439/56
2002/0193009 A1 12/2002 Reed
(Continued)

FOREIGN PATENT DOCUMENTS

CN 101154525 A 4/2008
CN 107733137 A 2/2018
(Continued)

OTHER PUBLICATIONS

Japanese Office Action (with English Translation) for corresponding Application No. 2020-054590, dated Apr. 6, 2021.
(Continued)

*Primary Examiner* — Oscar C Jimenez

(57) ABSTRACT

An electric unit such as an electric water pump or an electric radiator fan for a motor vehicle with a plug-in connection comprises a region of the connections between contact tongues and stripped ends of the individual wires of the cable of the plug is sealed, and that a sufficient tightness can be ensured in relation to the ingress of moisture along the wires from the surroundings of the water pump through the plug into the housing. A plug and method for producing the plug for a plug-in connection on an electric unit includes a strain relief means, and a seal in the region of the electric contact between the contact tongues and the wire ends of the individual wires.

17 Claims, 7 Drawing Sheets

Figure 1:
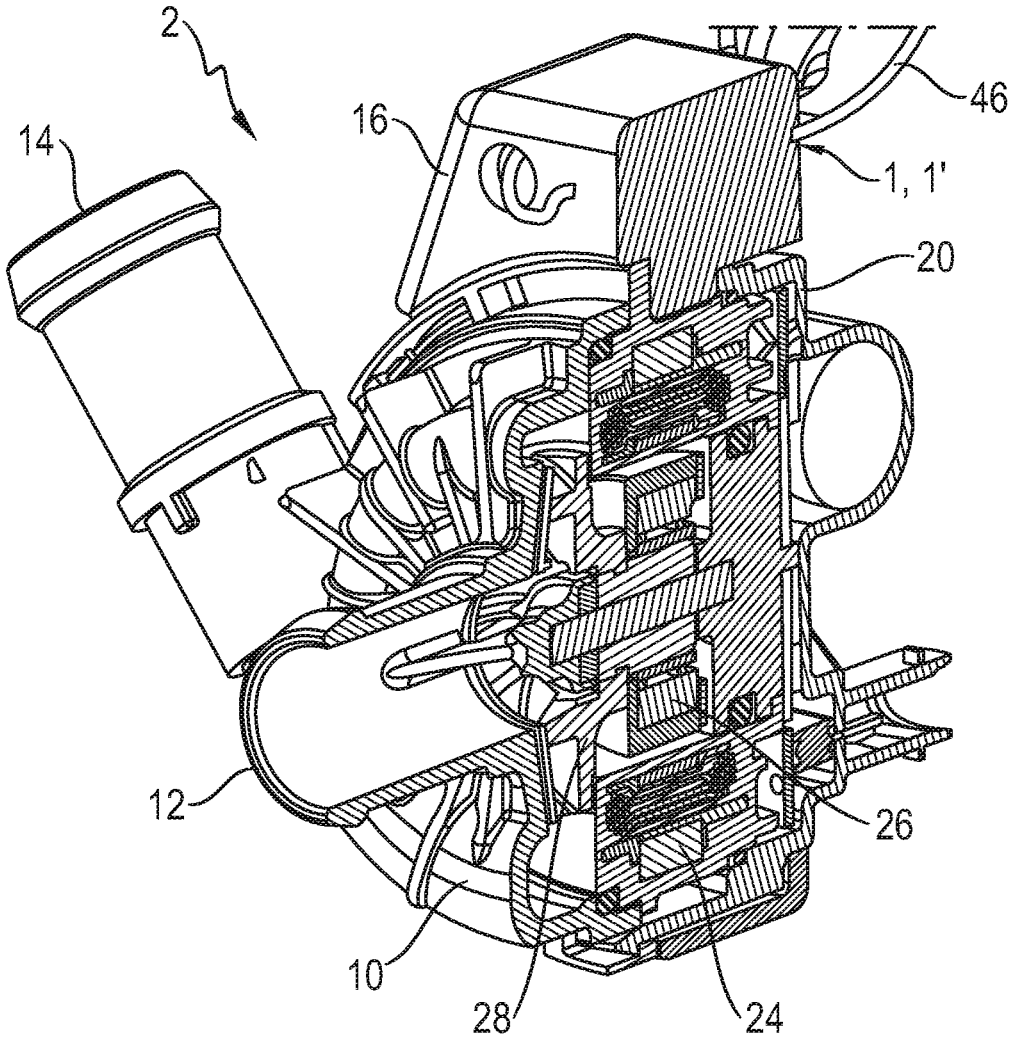

(51) Int. Cl.

| | |
|---|---|
| ***F04D 29/40*** | (2006.01) |
| ***H01R 13/405*** | (2006.01) |
| ***H01R 43/24*** | (2006.01) |
| ***H01R 13/58*** | (2006.01) |
| ***F04D 29/08*** | (2006.01) |

(52) U.S. Cl.
CPC ..... *H01R 13/405* (2013.01); *H01R 13/5216* (2013.01); *H01R 13/533* (2013.01); *H01R 13/5845* (2013.01); *H01R 43/24* (2013.01)

(56) References Cited

U.S. PATENT DOCUMENTS

| | | | | |
|---|---|---|---|---|
| 2008/0038942 | A1* | 2/2008 | Gordon | B60R 16/0315 439/76.2 |
| 2008/0073197 | A1 | 3/2008 | Saito et al. | |
| 2009/0258521 | A1* | 10/2009 | Ooki | H01R 13/5216 439/275 |
| 2018/0048218 | A1 | 2/2018 | Im et al. | |

FOREIGN PATENT DOCUMENTS

| | | | |
|---|---|---|---|
| CN | 109326914 | A | 2/2019 |
| DE | 19511056 | A1 | 10/1995 |
| DE | 102010025096 | B3 | 1/2012 |
| DE | 112013003253 | T5 | 4/2015 |
| DE | 112013003480 | T5 | 4/2015 |
| DE | 102015223597 | A1 | 6/2016 |
| EP | 01122840 | B1 | 8/2003 |
| EP | 1906420 | A2 | 4/2008 |
| JP | 2000228243 | A | 8/2000 |
| JP | 2008-084616 | A | 4/2008 |
| JP | 2010-231951 | A | 10/2010 |
| JP | 2013-54844 | A | 3/2013 |
| JP | 2018-027005 | A | 2/2018 |
| JP | 2019-030141 | A | 2/2019 |
| WO | 07101481 | A1 | 9/2007 |

OTHER PUBLICATIONS

Korean Office Action (with English Translation) for corresponding Application No. 10-2020-0027082, dated Apr. 20, 2021.

* cited by examiner

ELECTRIC UNIT FOR A MOTOR VEHICLE WITH A PLUG-IN CONNECTION, PLUG FOR A PLUG-IN CONNECTION ON AN ELECTRIC UNIT, AND METHOD FOR PRODUCING A PLUG FOR A PLUG-IN CONNECTION ON AN ELECTRIC UNIT

CROSS-REFERENCE TO RELATED APPLICATIONS

This application claims the benefit and priority of German Patent Application No. DE 10 2019 204 226.0 filed Mar. 27, 2019. The entire disclosure of the above application is incorporated herein by reference.

FIELD

The invention relates to an electric unit, such as an electric water pump or an electric radiator fan for a motor vehicle with a plug-in connection, to a plug for a plug-in connection on an electric unit of this type, and to a method for producing a plug for a plug-in connection on an electric unit of this type.

For example, electric water pumps or electric radiator fans are understood to be electric units for a motor vehicle.

BACKGROUND

Electric water pumps are well known, for example from U.S. Pat. No. 9,360,015 B1, and are driven by an electric machine which comprises a stator and a rotor. The rotor is connected to a pump impeller for moving a fluid. The fluid enters the pump through an inlet in a volute, is brought into contact with a pump impeller, and is moved through an outlet in the volute. The rotor and the stator of the electric machine are contained in a housing which is connected to the volute. The electronics for the electric machine are contained on a printed circuit board (PCB). The printed circuit board comprises the electronic components which control the operation of the electric machine electrically. The current supply or energy is delivered via a plug which is connected to a wiring harness of the vehicle electrics. Here, the electric contact takes place via electrically conducting contact tongues of the plug which are connected electrically to the individual wires/cores of the wiring harness which are contacted electrically with corresponding electrically conductive contact receptacles of the printed circuit board. Said contact between the printed circuit board and the plug is usually configured as a plug-in connection, the plug being plugged at least partially with contact tongues which are arranged on the end side into the housing of the water pump, and a contact with the printed circuit board being established.

Electric radiator fans are likewise known in a multiplicity of embodiments, and comprise a fan impeller which is arranged axially on a drivable shaft, and a fan motor for driving, the fan impeller and the fan motor being arranged in a housing. The electronics which control the operation of the electric machine are likewise situated within the housing. The power supply or energy is also delivered in the case of the radiator fan via a plug which is connected to a wiring harness of the vehicle electrics.

Here, in the case of plug-in connections of this type, in particular in the case of the application in a motor vehicle, the production of a plug and/or a plug-in connection which is sufficiently sealed is problematic, such that firstly the contact regions which are present in the plug between contact tongues and wire ends of the cable are protected, and such that, furthermore, there is a sufficient tightness in relation to the environmental influences, in particular of moisture, between the individual wires and/or cable of the plug and the plug carrier/plug housing which receives the wires, with the result that a penetration of moisture and/or gases via the plug starting from the surroundings of the housing of the pump into the pump housing and/or starting from the surroundings of the radiator fan into the housing of the radiator fan can be prevented.

SUMMARY

In a first aspect, the object of the invention consists in configuring an electric unit, such as a water pump or a radiator fan for a motor vehicle with a plug-in connection, in such a way that a simple and reliable electric contact is achieved which is distinguished, in particular, by the fact that the region of the connections between contact tongues and stripped ends of the individual wires of the cable of the plug is sealed, and that a sufficient tightness can be ensured, in particular, in relation to the ingress of moisture along the wires from the surroundings of the unit through the plug into the housing of the unit.

In a second aspect, the object consists in a development of a plug for a plug-in connection on an electric unit, such as a water pump or a radiator fan; the plug is to have, in particular, a strain relief means, and the plug having a seal, in particular in relation to moisture, in the region of the electric contact between the contact tongues and the wire ends of the cable, and it being possible for a sufficient tightness to be ensured with respect to, in particular, an ingress of moisture along the wires starting from the cable into the plug housing in the direction of the contact tongues.

In a third aspect of the present invention, a further object is considered to be a method for producing a plug for the plug-in connection of an electric unit. Here, in particular, an inexpensive, rapid, automatable method is to be provided.

The measures for sealing which are described in the following text provide a seal in relation to environmental influences. Within the context of the present invention, environmental influences are understood to mean atmospheric influences such as contaminants, dirt, water, oil and electrostatic discharges.

The object in the second aspect is achieved by way of the seal in the region of the electric connection between contact tongues and stripped ends of the individual wires of the cable in the plug is improved. Furthermore, a seal is achieved in the longitudinal direction of the cable or the individual wires, that is to say a seal between the cable sheath, the outer sheath of the wires and the plug housing, as a result of which a penetration of environmental influences in the region of the plug into the plug-in connection and into the housing of the unit, for example a water pump or a radiator fan, is avoided.

In addition, the plug according to the invention is configured in such a way that the individual wires of the cable are incorporated into the plug housing in a manner which is relieved from strain. This is achieved by virtue of the fact that the individual wires are plugged through corresponding bores of the plug housing, and that a non-positive/integrally joined connection is established between the individual wires and the plug housing in said leadthrough region on account of a heat process/hot pressing operation.

The potting compound consisting of a resin in the region of the connection between the individual wires and the contact tongues, which potting compound encloses the connection, produces a seal in said region and, in addition, is a barrier for penetrating atmospheric influences such as moisture along the individual wires, starting from the surroundings of the electric unit, through the plug into the housing of the electric unit.

In another embodiment which achieves the object in the first and second aspect, the stripped ends of the individual wires are connected to the contact tongues via a crimp connection. The crimp connection produces a reliable connection between the wire ends and the contact tongues. In the case of said exemplary embodiment, the seal between the individual wires and the contact tongues is produced via a thermoplastic material which encloses said connecting region and at the same time is embedded partially into a main carrier of the plug housing. As a result, a strain relief means of the individual wires is also achieved, in addition to the abovementioned sealing function which takes place via an adhesion between the plastic encapsulation of the individual wires and the thermoplastic material.

It is provided in one development of the invention that the plug of the plug-in connection has a pressure equalization duct which makes a pressure equalization possible between the housing interior of the electric unit, such as a water pump or a radiator fan, and the surroundings of the electric unit, such as a water pump or the radiator fan. By way of said advantageous refinement, the ventilation/pressure equalization can be provided in the plug in an integrated manner, with the result that a separate pressure equalization means at another location of the housing can be dispensed with.

The pressure equalization duct is advantageously provided with a membrane, preferably a Gore-Tex membrane, in the region of the inlet and/or outlet opening. As a result, a seal in relation to environmental influences such as moisture is also achieved in that region of the pressure equalization means which establishes a connection between the housing interior and the surroundings of the electric unit.

The inlet and/or outlet opening with a membrane is further advantageously arranged in that region of the plug which is in the interior of the housing after the assembly with the electric unit, such as the water pump or the radiator fan. At this location, the membrane is arranged at a protected location in the housing of the pump or the radiator fan.

In a third aspect, the present invention is achieved by way of a method for producing a plug.

The method can take place, in particular, in a rapid and automated manner. This can be achieved by virtue of the fact that, in accordance with the first exemplary embodiment of the plug, the contact tongues are fed in from a reel in the first method step. The seal as a barrier in the region of the contact between the wire ends and the contact tongues is advantageously produced by way of a potting compound in a casting process.

In accordance with one development of the method according to the invention, the membranes for sealing the pressure equalization ducts are fed in a manner which starts from a reel. As a result, the application of the membranes in the region of the inlet and outlet opening is considerably simplified, since separated membrane elements do not have to be gripped and applied.

Here, the fastening of the membranes preferably takes place via an ultrasonic welding method.

In accordance with a second design variant of the plug of the present invention, the method according to the invention is considerably simplified, in particular, by way of the production of a crimp connection between the wire ends and the contact tongues. Here, the strain relief means and the seal in the region of the wires and the plug housing are achieved rapidly and reliably by way of overmolding of a part region of the main carrier which produces a receptacle for the contact tongues, and of the wires in the region of the crimp connection with the contact tongues. Here, a thermoplastic material is preferably used as material.

Furthermore, in the case of the method with respect to the second exemplary embodiment, the second end region of the plug and the region of the barrier for sealing the contact points between the individual wires and the contact tongues are advantageously achieved by way of a thermoplastic material. As a result, the production method can be optimized, in particular, with regard to time. Curing times which are necessary in the case of the use of casting resins are dispensed with.

FIGURES

Figure 2:
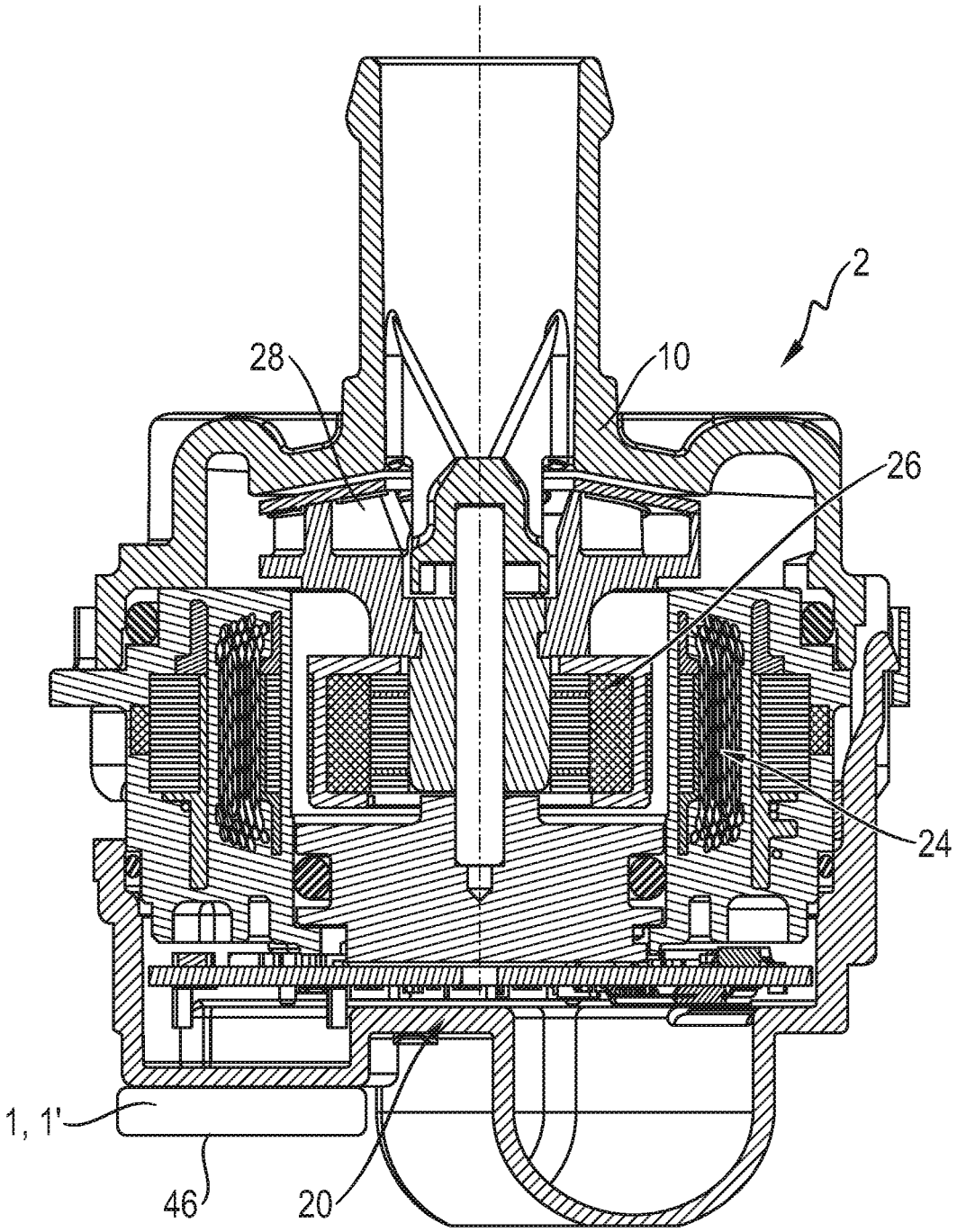
Figure 3:
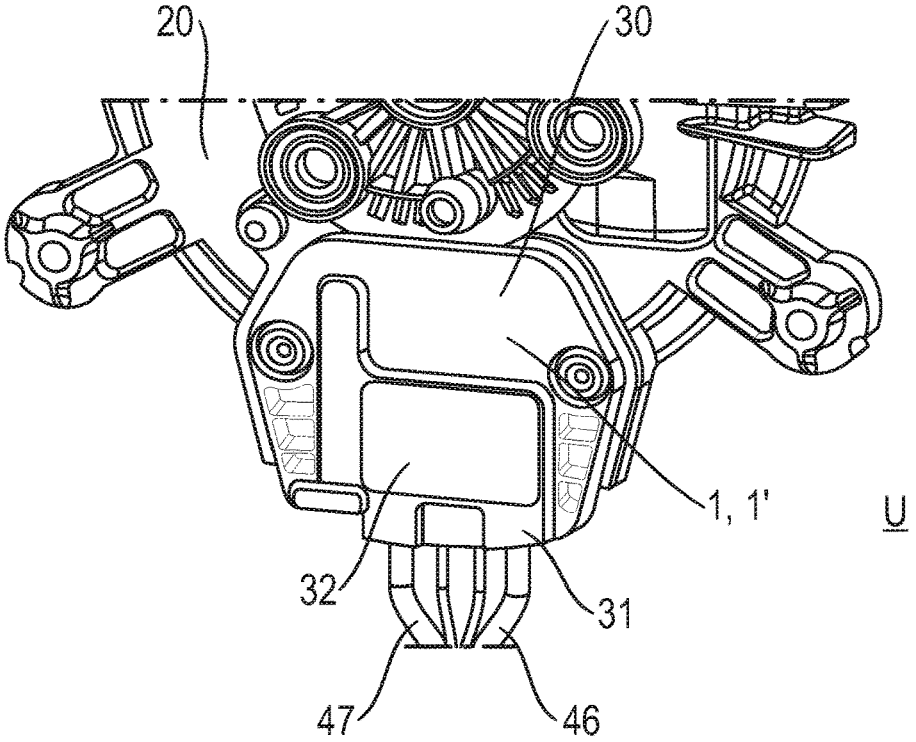
Figure 4:
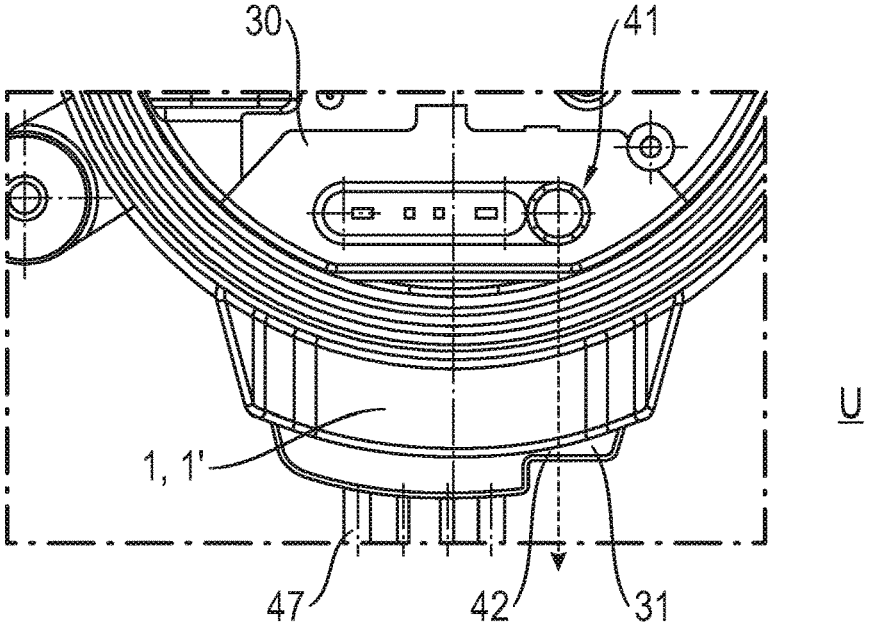
Figures 5A, 5B, 5C:
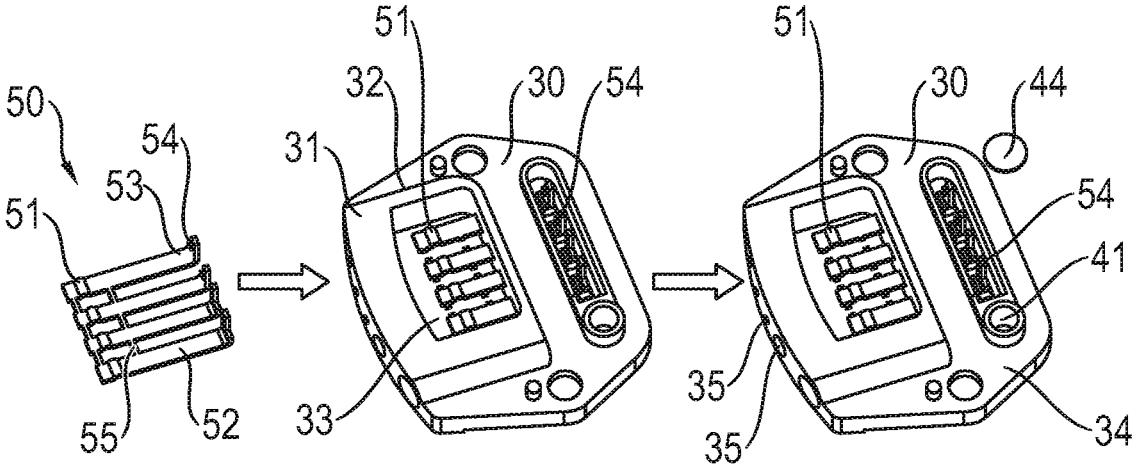
Figures 5D, 5E:
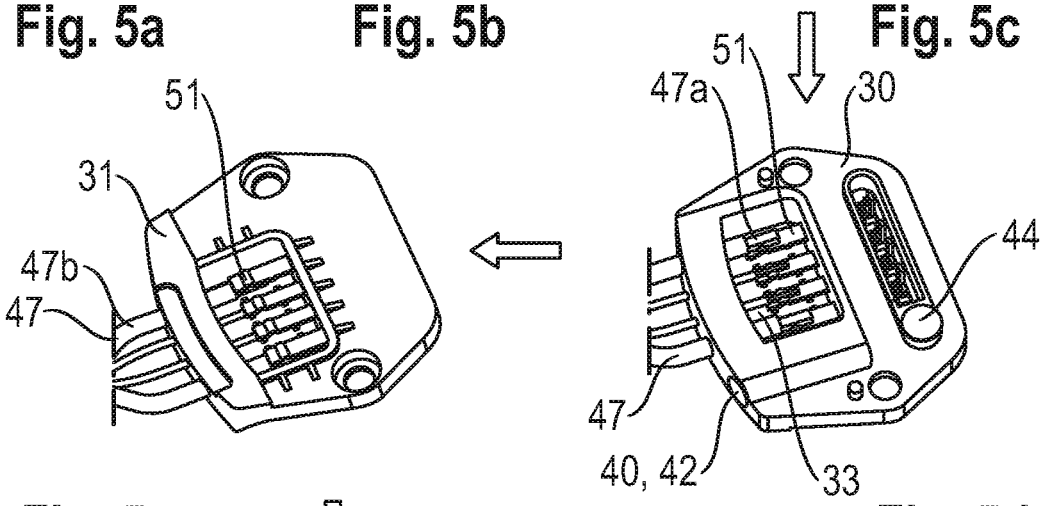
Figure 5F:
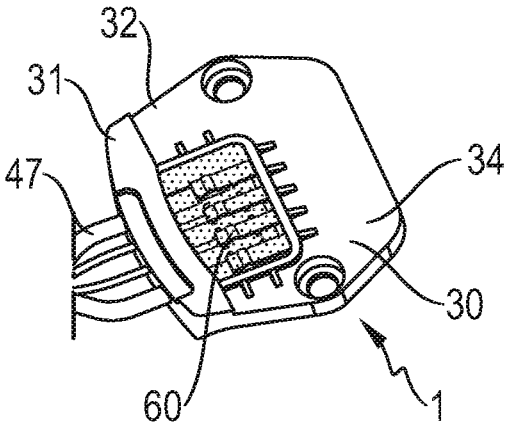
Figure 6:
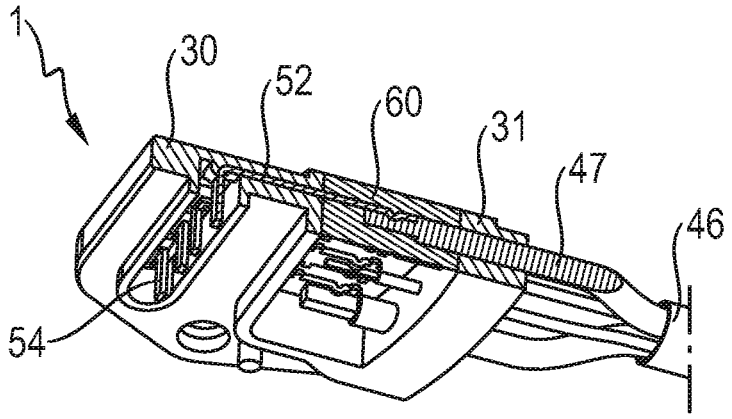
Figure 7:
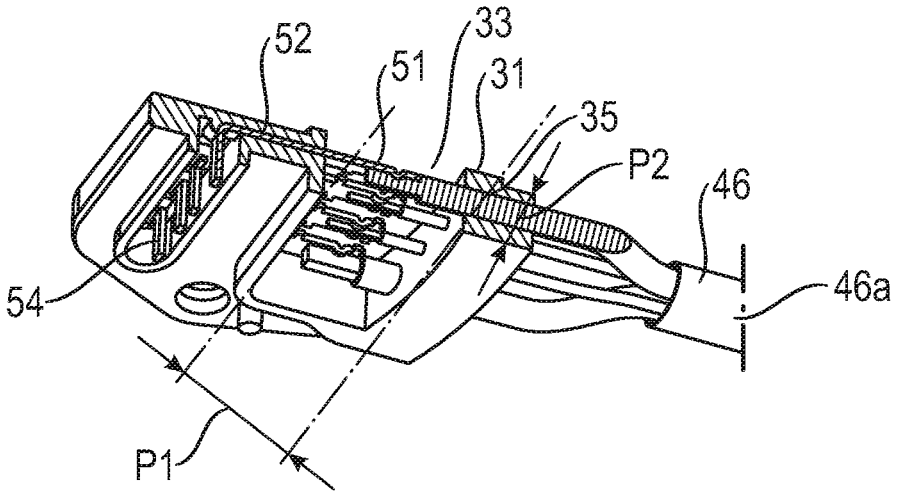
Figure 8:
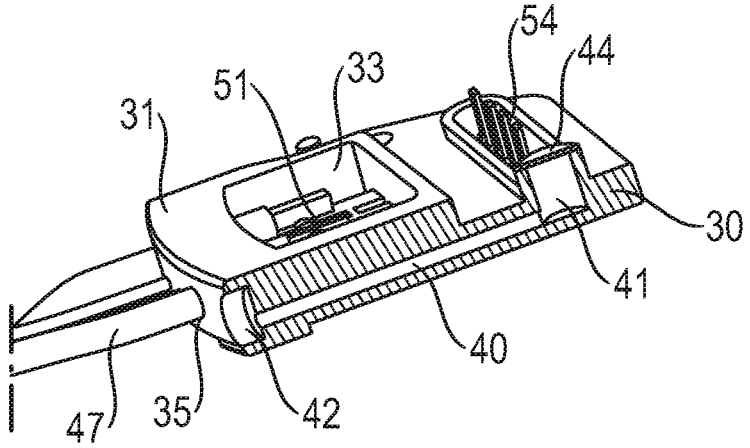
Figure 9A:
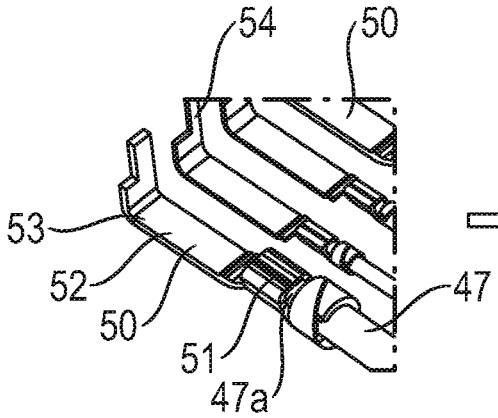
Figure 9B:
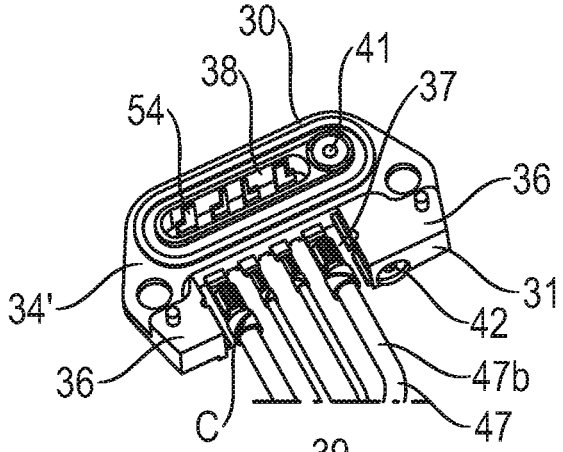
Figure 9B:
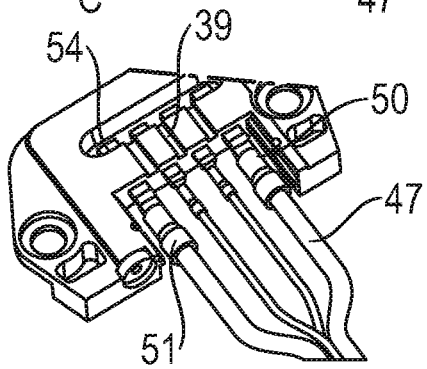
Figure 9C:
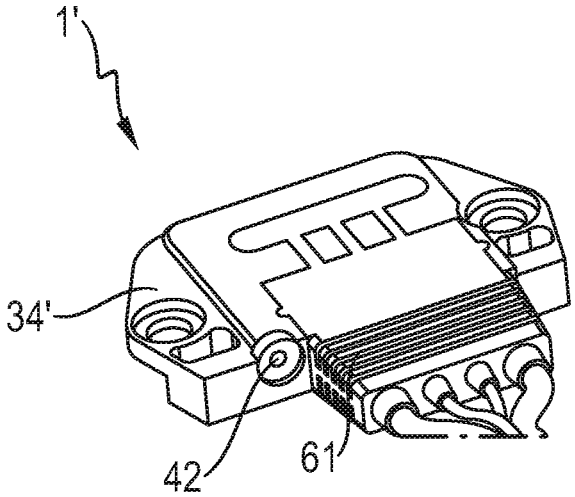
Figure 9C:
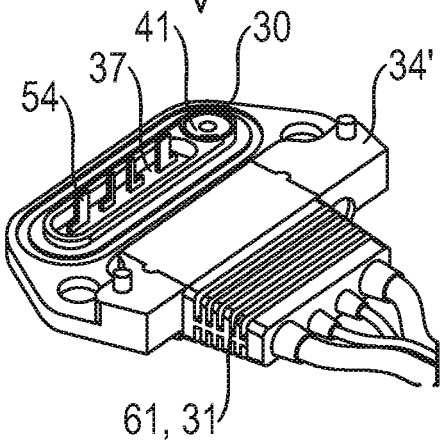
Figure 10:
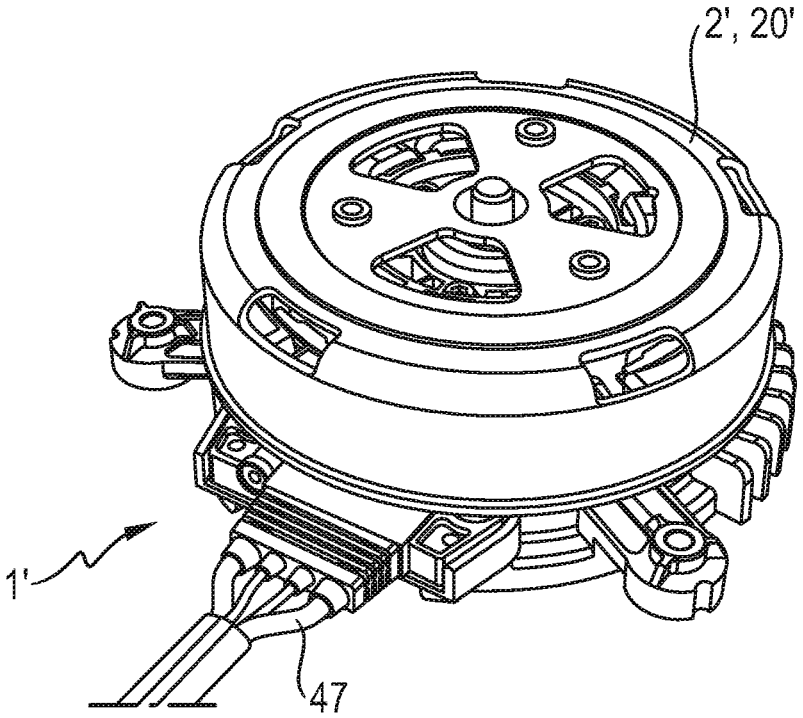
Figure 11:
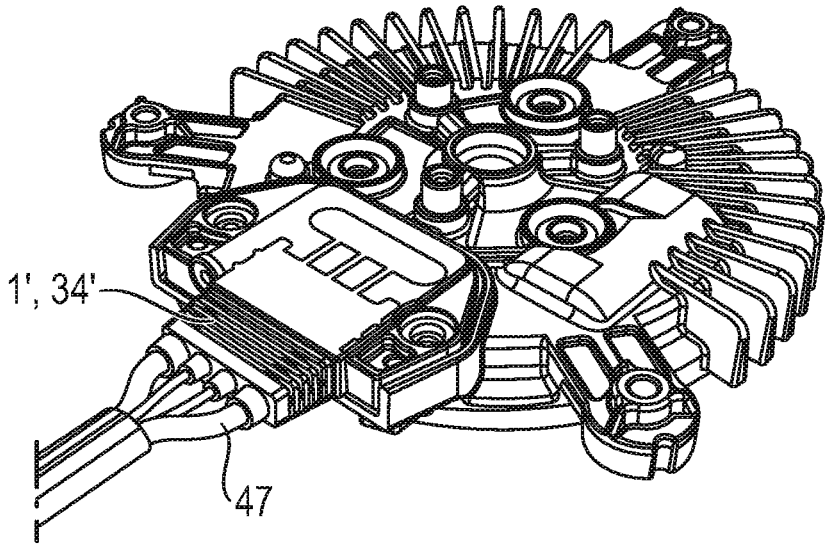

In the following text, the present invention will be described on the basis of exemplary embodiments, reference being made to the appended drawings, in which FIG. 1 shows an exemplary electric water pump in accordance with the invention, FIG. 2 shows a cross section of the exemplary electric water pump, FIG. 3 shows a detail of a housing of the water pump with an attached plug of the plug-in connection in a front view, FIG. 4 shows a detail of a housing of the water pump with an attached plug of the plug-in connection in a rear view, FIGS. 5*a*-5*f* show method steps for producing a first exemplary embodiment of a plug of the plug-in connection, FIG. 6 shows the plug according to the invention which is produced according to FIGS. 5*a*-5*f*, in a three-dimensional illustration in a view from below, FIG. 7 shows the plug according to the invention after the method step of FIGS. 5*d* and 5*e*, in an illustration from below in a cut-away state, FIG. 8 shows the plug according to the invention after the method step of FIGS. 5*d* and 5*e*, in another rotated perspective view in a sectioned view, FIGS. 9*a*-9*c* show method steps for producing a second exemplary embodiment of a plug of the plug-in connection, FIG. 10 shows a perspective view of a radiator fan with a plug in accordance with the second exemplary embodiment, and FIG. 11 shows a view of the interior of a radiator fan with a fan impeller and a mounted plug.

DETAILED DESCRIPTION

FIGS. 1 and 2 show an electric water pump which is known from the prior art. This is driven by an electric machine which comprises a stator 24 and a rotor 26. The rotor 26 is connected to a pump impeller 28 for moving a fluid. The fluid enters into the water pump through an inlet 12 in a volute 10, is brought into contact with the pump impeller 28, and is moved through an outlet 14 in the volute 10. The rotor 26 and the stator 24 of the electric machine are contained in a housing 20 which is connected to the volute 10. The electronics which are required for the actuation of the electric machine are contained on a printed circuit board (PCB) and are connected to contact receptacles. The current supply or energy for the electronics is delivered by means of a plug-in connection between the printed circuit board or the contact receptacles and the contact tongues of a plug 1. The contact tongues are contacted electrically with individual wires of the wiring harness/supply line 46, and are held in the plug 1 in a sealed and insulated manner. During the assembly, the plug 1 is plugged with contact tongues 30 which are arranged on the end side at least partially into the housing of the water pump. Here, the contact tongues are plugged into the contact receptacles on the printed circuit board, and an electric contact is established between the plug 1 and the printed circuit board. The figures do not show the plug-in connection which comprises the plug 1 or the contact tongues and the contact receptacles of the printed circuit board.

FIGS. 1 and 2 show the arrangement of the plug 1, 1' on the housing 20 of the pump 2 in a merely diagrammatic manner. As has already been mentioned at the outset, in order to form a plug-in connection, the plug 1, 1' can be contacted electrically with a multiplicity of corresponding plug-in contacts/contact receptacles of an electric unit in a motor vehicle.

FIGS. 3 and 4 show the plug 1 in the mounted situation of the plug-in connection on a housing element 20 of the water pump 2. The printed circuit board with the corresponding plug-in contacts/contact receptacles is not shown. It can be seen from the illustrations that a first end region 30 of the plug 1 is situated within the housing 20 of the water pump 2 in the mounted situation, and the opposite second end region 31 with the supply cable 46 protrudes out of the housing 20 of the water pump 2. The first end region 30 of the plug 1 is preferably arranged in a region of the water pump, which region comprises an air space and requires a pressure equalization. In order to make the pressure equalization possible, the plug 1 is provided with a pressure equalization duct 40; the pressure equalization duct 40 is arranged in such a way that, starting from an inlet or outlet opening 41 which is arranged in the first end region 30 of the plug, it opens into an inlet or outlet opening 42 which is arranged in the second end region 31 of the plug 1. As a result, after the mounting of the plug 1 in the housing 20, a connection is established between the air space in the housing 20 and the surrounding space U of the water pump 2 in the motor vehicle. The inlet/outlet opening 41 which is arranged on the first end region 30 of the plug 1 is covered by way of a membrane 44, preferably a Gore-Tex membrane, and therefore forms a ventilating opening which likewise prevents the penetration of moisture. On account of the arrangement of the membrane 44 within the housing 20, it is protected from the outside. As an alternative, the membrane 44 can also be arranged on the inlet/outlet opening 42 on the second end region 31.

FIGS. 5*a*-5*f* show the method according to the invention for producing a plug 1 for a plug-in connection on a water pump 2 in a first embodiment.

In a first method step according to FIG. 5*a*, contact tongues 50 which establish an electric contact with the individual cores 47 of the current supply line/cable 46 of the vehicle electrics are first of all provided. Here, the number of contact tongues 50 corresponds to the number of individual wires/cores 47 of the current supply cable 46 which are to be contacted. The contact tongues 50 are produced from an electrically conductive material, and are configured as elongate contact pins with a first end region 51, a central region 52 and a second end region 53. The second end region 53 has ends 54 which are angled away by 90 degrees. The contact pins are arranged spaced apart in parallel from one another, and are connected to one another in the first end region 51 via transverse webs 55. The contact tongues/contact pins 50 are received in a stored manner on a reel, and contact tongues are separated and made available in accordance with the required number, namely four contact tongues 50 which are arranged parallel to one another in accordance with the illustration.

In a second method step according to FIG. 5*b*, the contact tongues 50 are inserted into a mold and, in a molding method, the plug housing 34 is formed from a plastic material, is preferably cast or transfer molded from a thermosetting plastic material. Here, the mold for producing the plug housing 34 is configured in such a way that the plug housing 34 is configured substantially as a plate-shaped element with a first end region 30 and an opposite second end region 31. Between the first end region 30 and the second end region 31, the plug housing 34 has a central region 32 which comprises a window-like recess 33. The second end region 31 is configured with through bores 35 which are arranged spaced apart in parallel for receiving the individual wires 47. After the molding method, the contact tongues 50 are held in the first end region 30 such that they are overmolded in their central region 52 in such a way that the angled-away ends 54 of the second end region 53 project freely toward the outside, starting from the plate-shaped element. Starting from the first end region 30 of the plug housing 34, the first end regions of the contact tongues 51 protrude freely into the window-like recess 33.

Furthermore, the plug housing 34 is configured with a ventilating duct 40 which, starting from an inlet/outlet opening 42 which is arranged in the longitudinal direction in the second end region 31, runs into an inlet/outlet opening 41 which is configured angled-away by 90 degrees in the first end region 30.

After the molding of the plug housing 34, the latter is removed with embedded contact tongues 50 from the mold, and the transverse connections 55 between the contact tongues 50 are removed.

In a subsequent method step 5*c*, the inlet/outlet opening 41 in the first end region 30 is covered by way of an ultrasonic welding method with a membrane 44, preferably a Gore-Tex membrane.

FIG. 5*d* shows the next method step, in the case of which the individual wires 47 of the supply line 46 (in accordance with exemplary embodiment 4) are plugged by means of their stripped ends 47*a* through the through bores 35 in the second end region 31, and are soldered onto the exposed first end regions 51 of the contact tongues 50 in order to establish an electric contact.

Afterward, a strain-resistant connection is produced between the individual wires 47 in the through bores 35 by way of the application of heat and/or pressure in said region, as a result of which melting of the encapsulation 47*b* of the individual wires 47 and an integrally joined connection to the plastic material of the plug housing 34 are achieved (FIG. 5*e* shows the plug housing from the upper side).

After the production of the strain-resistant connection between the individual wires 47 and the plug housing 34 in its second end region 31, an insulation and sealing material 60, preferably a resin, is cast into the window-like recess 33 in a final method step according to FIG. 5*f*, and is distributed there completely. As a result, the soldered contact points between the individual wires 47 and the contact tongues 50 are overmolded and embedded completely by the material, with the result that a protection and/or a seal against environmental influences are/is achieved. In particular, said region which is overmolded with resin produces a barrier 60, with the result that, starting from the second end region 31 of the plug 1, which second end region 31 is exposed to the surroundings U in the mounted state, no environmental influences at all, such as moisture, can pass along the individual wires 47 into the plug housing 34 to the first end region 30 of the plug 1, which first end region 30 is arranged in the housing 20 of the water pump 2.

FIG. 6 shows the finished plug 1 in a perspective view from below of the free angled-away ends 54 of the contact tongues 50 and of the soldered contacts which are embedded into the potting compound 60 between the contact tongues and the individual wires/cores 47 of the supply line in the central region 32 of the plug 1.

The illustration of FIG. 7 shows the barrier 60 by way of the arrows P1, which barrier 60 is formed in the window-like recess 33 by way of the potting compound. Furthermore, the region which forms the strain relief means of the individual wires 47 is marked by way of the arrows P2. The right hand side of the figure shows the supply cable 46 which is formed from the individual wires 47 and which comprises an encapsulation 46*a*.

The sectional illustration of FIG. 8 shows the course of the ventilating bore with the inlet and outlet openings.

FIGS. 9*a*-9*c* show a further method according to the invention for producing a plug for a plug-in connection on a water pump in a second embodiment.

In contrast to the above-described production method, in accordance with the second embodiment (shown in FIG. 9*a*) of a plug 1*a*, the contact tongues 50 are connected in a first method step via a crimp connection C on their first end region 51 to the stripped ends 47*a* of the individual wires 47 of the supply line 46, and are therefore contacted electrically. As has already been described above, the contact tongues 50 are produced from an electrically conductive material, and are configured as elongate contact pins with a first end region 51, a central region 52 and a second end region 53. The second end region 53 has ends 54 which are angled away by 90 degrees. The contact pins are arranged spaced apart in parallel from one another, and are connected to one another via transverse webs 55 in the first end region 51, and are configured to produce a crimp connection C. The contact tongues/contact pins 50 are received in a stored manner on a reel, and are separated and made available in accordance with the required number of contact tongues, namely four contact tongues 50 which are arranged parallel to one another in accordance with the illustration.

In a second method step according to FIG. 9*b*, the contact tongues 50 are inserted with crimped-on individual wires 47 into a mold, and, in a molding method, the plug housing 34' is molded from a plastic material, is preferably cast or transfer molded from a thermosetting plastic material. Here, the mold for producing the plug housing 34' is configured in such a way that the plug housing 34' is formed substantially as a plate-shaped element with a first end region 30 and laterally integrally formed limbs 36. The plug housing 34' has a U-shaped recess 37 between the first end region 30 and the laterally integrally formed limbs 36. Furthermore, an elongate recess 38 and a plurality of grooves 39 which connect the elongate recess 38 and the U-shaped recess 37 are formed in the first end region 30.

After the molding method, the contact tongues 50 are held in the first end region 30 such that they are overmolded in their central region 52 in such a way that the angled-away ends 54 of the second end region 53 project freely toward the outside, starting from the plate-shaped element, and lie in an elongate recess 38 of the first end region 30. The first end regions 51 of the contact tongues 50 with crimped-on individual wires 47 protrude freely into the U-shaped recess 37, starting from the first end region 30 of the plug housing 34'.

Furthermore, the plug housing 34' is configured with a ventilating duct 40 which, starting from an inlet/outlet opening 42 which is arranged in the longitudinal direction in a lateral limb 36, runs into an inlet/outlet opening 41 which is configured angled-away by 90 degrees in the first end region 30.

The left hand illustration of FIG. 9*b* shows the plug 1' after the above-described molding method from below. The right hand illustration shows the plug 1' in the method step in a view from above.

In a subsequent method step which is shown in FIG. 9*c*, the plug housing 1', in the region of the U-shaped recess 37 with the lateral side regions 36 of the contact housing 34' which adjoin the U-shaped recess 37, with contact tongues and a contact to the individual wires 47, and the first end region 30 of the plug housing 34', in the region of the elongate recess 38 and the grooves 39, are overmolded with a thermoplastic material, and the second end region 31 of the plug 1' is completely configured. Said second end region 31 is extended in the direction of the supply cable 46, starting from the U-shaped recess 37.

As can be seen from the right hand depiction of FIG. 9*c*, the elongate recess 38 is injection molded in such a way that the angled-away ends of the contact tongues 54 remain free. By way of the overmolding of the abovementioned regions, a strain-resistant connection is achieved by way of adhesion between the individual wires 47 and the thermoplastic material 61 which is molded onto the plug housing 34'. Furthermore, the crimped-on contact points between the individual wires and the contact tongues are overmolded and embedded completely by the material 61, with the result that a protection and/or a seal against environmental influences are/is achieved. In particular, said region which is overmolded with thermoplastic material 61 produces a barrier 61 between the limbs, with the result that, starting from said overmolded second end region 31 of the plug 1', which second end region 31 is exposed to the surroundings in the mounted state, no environmental influences at all, such as moisture, can pass along the individual wires 47 into the plug housing 34' to the first end region 30 of the plug, which first end region 30 is arranged in the housing 20 of the water pump 2.

Before the injection molding with the thermoplastic material or following it, the membrane 44 can be welded by means of ultrasonic welding onto the inlet/outlet opening 41 in the first end region 30.

FIGS. 10 and 11 show a radiator fan 2' as an electric unit with an installed plug 1' in accordance with the second exemplary embodiment. It can be seen from the illustration of FIG. 10 that at least the first end region of the plug housing 34' is received in the interior space of the radiator fan in a manner which is enclosed by the housing 20'. It goes without saying that the plug 1 of the first exemplary embodiment can also be plugged into the housing 20' in order to form a plug-in connection to a corresponding plug-in contact on a printed circuit board of the electronics.

What is claimed is:

1. An electric unit with a plug-in connection for electric attachment to the vehicle electrics, the electric unit comprising a housing, in which an electric machine and electronics for the actuation of the electric machine are received, the electronics being arranged on a printed circuit board and being connected to contact receptacles, and a plug which supplies current supply or energy for the electronics via electric contact between the contact receptacles and contact tongues of the plug, the contact between the contact receptacles and contact tongues taking place in a first end region of a plug housing, the contact tongues making electric contact with individual wires of a supply line of the vehicle electrics and being held in an insulated manner, sealed in a central region of the plug housing, the plug housing comprising, furthermore, a second end region, out of which the individual wires are routed, and the plug being received at least with its first end region and also with its central region in the housing of the electric unit, the plug being arranged in a region of the housing, which region requires a pressure equalization, and, for the purposes of ventilation, the plug having a ventilating duct which, starting from an inlet/outlet opening in the first end region, opens into an inlet/outlet opening in the second end region, and an equalization between the housing interior space and the outer surroundings of the housing therefore being possible.

2. The electric unit for a motor vehicle having a plug-in connection according to claim 1, at least one of the two inlet/outlet openings being closed by way of a membrane, preferably a Gore-Tex membrane.

3. The plug according to claim 1, at least one of the two inlet/outlet openings, preferably the inlet/outlet opening in the first end region, being sealed by way of a membrane, preferably a Gore-Tex membrane.

4. A plug for a plug-in connection on an electric unit, which the plug comprises a plug housing which is produced from a plastic with a first end region, a second end region and a central region, a number of contact tongues being provided which comprise a first end region, a second end region and a central region, and the number of contact tongues being held at least in their central region in a manner which is encapsulated by plastic in the first end region, and a number of individual wires of a multicore cable being routed out of the second end region of the plug housing, the number of individual wires comprising an insulating encapsulation and a stripped end region, and being connected and electrically contacted by way of the stripped end region in the central region of the plug housing to/with the first end region of the contact tongues, and at least the contact points between the number of individual wires and contact tongues in the central region of the plug housing being potted by a sealing mass, preferably a resin, or being held in a manner which is overmolded, sealed or embedded by a thermoplastic material, and the plug comprising, furthermore, a strain relief means for the individual wires, the plug housing comprising a ventilating duct/pressure equalization duct which, starting from an inlet/outlet opening which is arranged in the first end region, opens into an inlet/outlet opening which is arranged in the second end region.

5. The plug according to claim 4, the plug housing being configured from a shaped plastic material as a plate-shaped element, and the central region of the plug housing having a window-like recess, and the window-like recess, in which the contact points/electric contact between contact tongues and individual wires are configured, being filled with the sealing potting compound.

6. The plug according to claim 4, the second end region of the plug housing having a number of through bores, in which the individual wires are held in a led-through manner, and an integrally joined connection for achieving the strain relief means being configured between the insulating encapsulation of the individual wires and the plug housing in the region of the through bores.

7. The plug according to claim 4, the plug housing being formed as a plate-shaped element with the first end region and integrally formed lateral limbs which form a central and second end region, a U-shaped recess being formed between a first end region and the lateral limbs, and an elongate recess being configured in the first end region, in which the elongate recess and the second end regions of the contact tongues are positioned.

8. The plug according to claim 7, the U-shaped recess, with the contact points between the contact tongues and the individual wires, and the side regions of the plug housing which delimit the U-shaped recess, and the elongate recess of the first end region of the plug housing being overmolded by the thermoplastic material in order to achieve the seal by way of a thermoplastic material in such a way that at least the ends of the contact tongues in the first end region remain free for contact with contact receptacles, and the strain relief means being formed by way of the embedding of the individual wires in the thermoplastic material.

9. The plug according to claim 4, the contact between the contact tongues and the individual wires being achieved via a soldered connection.

10. The plug according to claim 4, the contact between the contact tongues and the individual wires being achieved via a crimp connection.

11. A method for producing a plug for a plug-in connection on an electric unit, having the following method steps:

a) providing of a number of contact tongues made from an electrically conductive material, the contact tongues having a first end region, a central region and a second end region which preferably comprises ends which are bent away by 90 degrees, b) providing of a mold for producing a plug housing from a plastic material with a first end region, a central region with a window-like recess, and a second end region with through bores for the individual wires, c) inserting of the contact tongues into the mold in such a way that, after the molding method, they are held in the first end region of the plug housing such that they are encapsulated in their central region by the plastic, the second end regions are freely accessible, and the first end regions of the contact tongues are arranged in the window-like section, d) producing of the plug housing with formed contact tongues by way of a plastic shaping method in the mold, preferably by way of a casting method, injection molding method or transfer molding method, e) providing of a multicore supply cable with a number of individual wires, the individual wires comprising an insulating encapsulation and a stripped end region, f) plugging of the individual wires through the through bores in the second end region of the plug housing, g) producing of an electrically conductive connection between the number of individual wires and the first end region of the contact tongues, h) producing of an integrally joined and/or non-positive connection between the encapsulation of the individual wires and the through bores by way of the supply of heat and/or pressure, i) producing of a seal in the window-like recess by way of casting of a sealing potting compound, preferably a resin, into the window-like recess, the plug housing being produced with a ventilating duct which, starting from an inlet/outlet opening in the first end region of the plug housing, opens into an inlet/outlet opening in the second end region of the plug housing.

12. The method for producing a plug according to claim 11, the contact tongues being fed in an automated manner, starting from a reel.

13. The method for producing a plug according to claim 11, the contact tongues being fed in an automated manner, starting from a reel.

14. A method for producing a plug for a plug-in connection on an electric unit, having the following method steps:

a) providing of a number of contact tongues made from an electrically conductive material, the contact tongues having a first end region, a central region and a second end region which preferably comprises ends which are angled away by 90 degrees, b) providing of a multicore supply cable with a number of individual wires, the individual wires comprising an insulating encapsulation and a stripped end region, c) producing of an electrically conductive connection between the number of individual wires and the first end region of the contact tongues, d) providing of a mold for producing a plug housing from a plastic material with a first end region which comprises an elongate recess and laterally integrally formed limbs with a central region and a second end region and a U-shaped recess which is configured between the limbs, e) inserting of the contact tongues with connected individual cores into the mold in such a way that, after the molding method, the contact tongues are held in the first end region of the plug housing such that they are encapsulated by the plastic in their central region, and the second end regions are arranged in the elongate recess such that they are freely accessible, and the first end regions of the contact tongues with connected individual cores are arranged in the U-shaped recess, f) producing of the plug housing with formed contact tongues by way of a plastic shaping method in the mold, preferably by way of a casting method, injection molding method or transfer molding method, g) producing of a seal by way of overmolding of the U-shaped recess, with the contact points between the contact tongues and the individual wires, and the side regions of the plug housing which delimit the U-shaped recess, and the elongate recess of the first end region of the plug housing with thermoplastic material in such a way that at least the ends of the second end regions of the contact tongues remain free for contact with contact receptacles, and the strain relief means being formed by way of the embedding of the individual wires in the thermoplastic material, and the second end region of the plug housing being added.

15. The method for producing a plug according to claim 14, the plug housing being produced with a ventilating duct which, starting from an inlet/outlet opening in the first end region of the plug housing, opens into an inlet/outlet opening in the second end region of the plug housing.

16. The method for producing a plug according to claim 15, a seal, preferably a Gore-Tex membrane for sealing against environmental influences, being applied in a further method step to at least one of the inlet/outlet openings, preferably the inlet/outlet opening in the first end region.

17. The method according to claim 16, the application taking place by way of an ultrasonic welding method.

* * * * *